US006925773B2

(12) United States Patent
Gregel et al.

(10) Patent No.: US 6,925,773 B2
(45) Date of Patent: Aug. 9, 2005

(54) REINFORCING BAR CONNECTION AND METHOD

(75) Inventors: John J. Gregel, Bedford, OH (US); Louis J. Colarusso, Macedonia, OH (US); Lawrence Gene Gatton, Cuyahoga Falls, OH (US)

(73) Assignee: Erico International Corporation, Solon, OH (US)

( * ) Notice: Subject to any disclaimer, the term of this patent is extended or adjusted under 35 U.S.C. 154(b) by 412 days.

(21) Appl. No.: 10/081,376

(22) Filed: Feb. 21, 2002

(65) Prior Publication Data

US 2002/0114664 A1 Aug. 22, 2002

Related U.S. Application Data

(60) Provisional application No. 60/270,423, filed on Feb. 21, 2001.

(51) Int. Cl.[7] ..... E04C 5/16; E04B 1/38

(52) U.S. Cl. ..... 52/726.1; 52/740.1; 52/745.21; 403/265; 403/305

(58) Field of Search ..... 52/726.1, 726.2, 52/223.8, 719, 740.1, 745.21; 403/305, 314, 255–268

(56) References Cited

U.S. PATENT DOCUMENTS 1,689,281 A 10/1928 Forssell
2,648,883 A * 8/1953 Dupre ..... 403/371
2,781,658 A 2/1957 Dobell
4,627,212 A * 12/1986 Yee ..... 52/726.1
5,392,582 A * 2/1995 Abukawa ..... 52/726.1
5,732,525 A 3/1998 Mochizuki et al.

FOREIGN PATENT DOCUMENTS

DE 31 45924 11/1981
DE 222374 * 5/1985 ..... 52/126.1
GB 2 034 857 6/1980
GB 2 192 210 1/1988
GB 2247889 A * 3/1992

OTHER PUBLICATIONS

European Search Report from European Application No. 02003718.0.

* cited by examiner

*Primary Examiner*—Winnie Yip
(74) *Attorney, Agent, or Firm*—Renner, Otto, Boisselle & Sklar, LLP

(57) ABSTRACT

A reinforcing bar connection for concrete construction utilizes a sleeve supporting internal spring washers having flexible inner edges which engage a bar inserted in the sleeve. The reinforced inner edges of the washers bite into the bar and grip the bar preventing withdrawal. The washers have openings which permit the sleeve to be filled with a hardenable matrix such as grout or resin. In a preferred form, shoulder forming wedge grooves are formed in ends of the sleeve. The connection may be used as a dowel socket, a continuity set, or as butt end-to-end bar splice for axially aligned bar of the same or different size. The connection provides not only high compressive and tensile strengths but also will provide the dynamic and/or fatigue characteristics to qualify as Type 2 coupler approved for use in all United States earthquake zones.

19 Claims, 5 Drawing Sheets

REINFORCING BAR CONNECTION AND METHOD

This application claims priority from U.S. Provisional Application No. 60/270,423, filed Feb. 21, 2001.

TECHNICAL FIELD

This invention relates generally as indicated to a reinforcing bar connection, and more particularly to a high strength reinforcing bar splice which provides not only high tensile and compressive strengths, but also has the dynamic or fatigue characteristics to qualify as a Type 2 coupler approved for all earthquake zones in the United States. The invention also relates to a method of making the connection.

BACKGROUND OF THE INVENTION

In steel reinforced concrete construction, there are generally three types of splices or connections; namely lap splices; mechanical splices; and welding. Probably the most common is the lap splice where two bar ends are lapped side-by-side and wire tied together. The bar ends are of course axially offset which creates design problems, and eccentric loading whether compressive or tensile from bar-to-bar. Welding is suitable for some bar steels but not for others and the heat may actually weaken some bars. Done correctly, it requires great skill and is expensive. Mechanical splices normally require a bar end preparation or treatment such as threading, upsetting or both. They also may require careful torquing. Such mechanical splices don't necessarily have high compressive and tensile strength, nor can they necessarily qualify as a Type 2 mechanical high fatigue strength connection.

Accordingly, it would be desirable to have a high strength coupler which will qualify as a Type 2 coupler permitted anywhere in a structure in all four earthquake zones of the United States, and yet which is easy to assemble and join in the field and which does not require bar end preparation or torquing in the assembly process. It would also be desirable to have a coupler which could be assembled initially simply by sticking a bar end in an end of a coupler sleeve or by placing a coupler sleeve on a bar end.

SUMMARY OF THE INVENTION

A reinforcing bar connection for reinforced concrete construction utilizes spring washers mounted in a sleeve. The washers have flexible inner edges which deflect when a bar end is inserted through the washers. The reinforced inner edges of the washers bite into and grip the bar end preventing withdrawal. The connection may be used as a socket in a dowel bar extension, a continuity set, or in a butt splice joining axially aligned bars of the same or different size. The sleeve with the bars locked in place is filled with a grout or other hardenable matrix. In a preferred form wedge grooves forming shoulders are formed in the ends of the sleeve. These grooves enhance the tensile elongation performance of the connection. The sleeve may have a substantial number of washers facing in opposite directions to grip bars inserted in either axial end to a stop. The connection or splice provides not only high compression and tensile strength but also the dynamic and/or fatigue strength to complete the cycle tests to qualify as a Type 2 coupler useful anywhere in a structure in all earthquake zones in the United States.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION

Figure 1:
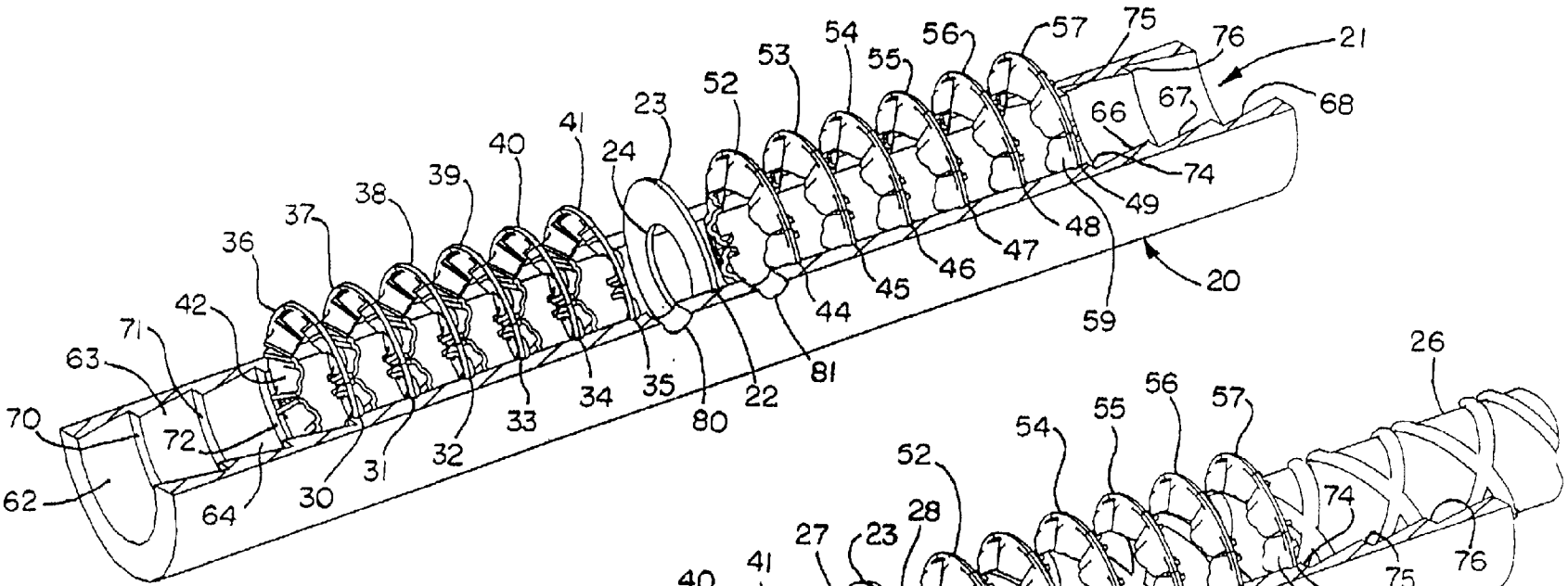
FIG. 1 is a perspective view of a connection with the upper half of the sleeve removed showing the finger washers in each end of the sleeve, the wedge grooves at the ends of the sleeves, and the center stop disk or washer.
Figure 2:
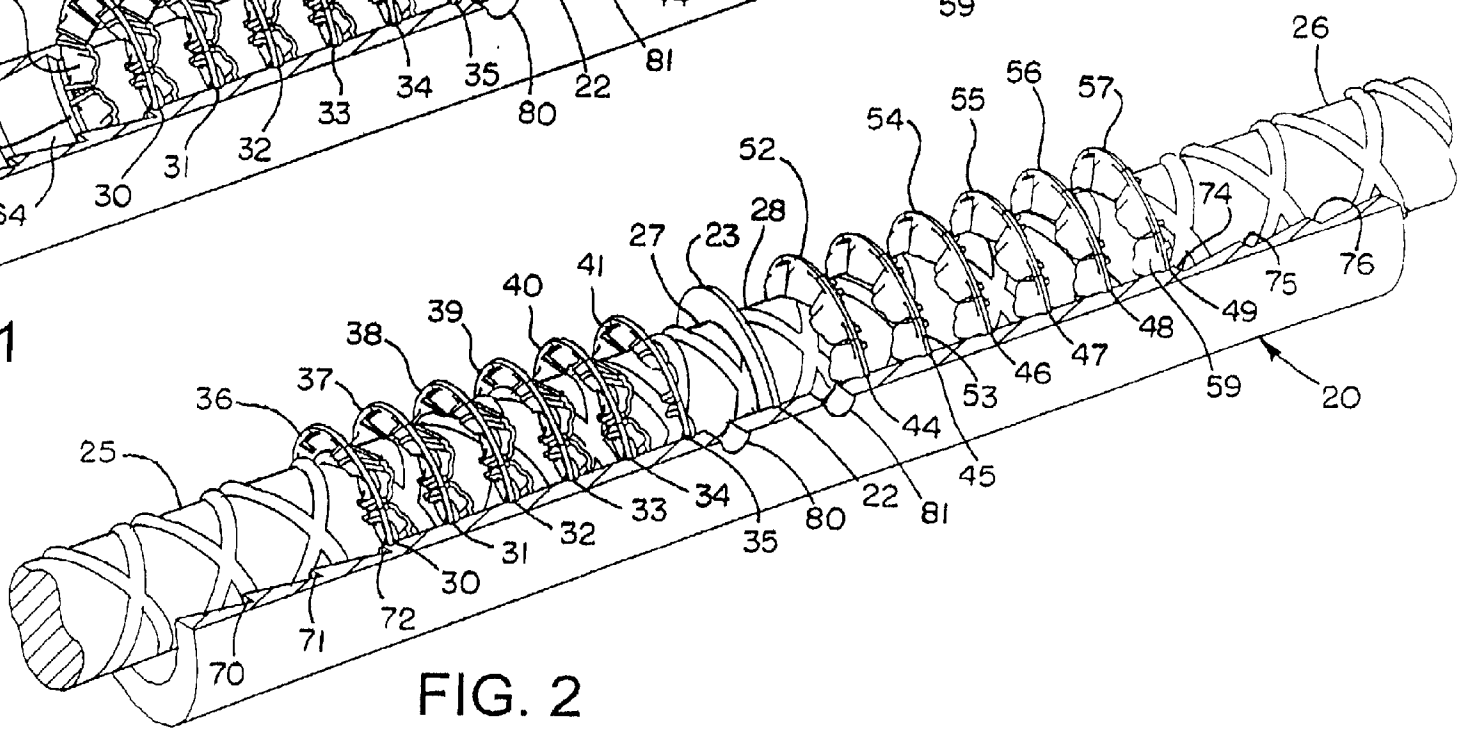
FIG. 2 is a view like FIG. 1 but with the bar ends inserted.

Referring initially to FIGS. 1 through 4, there is illustrated a coupling sleeve shown generally at 20. The upper half of the sleeve has been removed for clarity of illustration in FIGS. 1 and 2. The sleeve 20 is generally cylindrical and is provided with a through hole indicated at 21 extending from end-to-end. The center of the sleeve is provided with an interior groove indicated at 22 adapted to receive a stop washer (also referred to herein as a "stop disc") shown generally at 23. The stop washer is thus positioned at the substantial mid-point of the sleeve. The stop washer is provided with a central opening 24 smaller than the diameter of the bars being joined, which are shown at 25 and 26 in FIG. 2. As illustrated in FIG. 2, the bars 25 and 26 are deformed reinforcing bar for use in concrete construction and the ends of the bars shown at 27 and 28, respectively, abut against the stop washer or disc 23.

Figure 3:
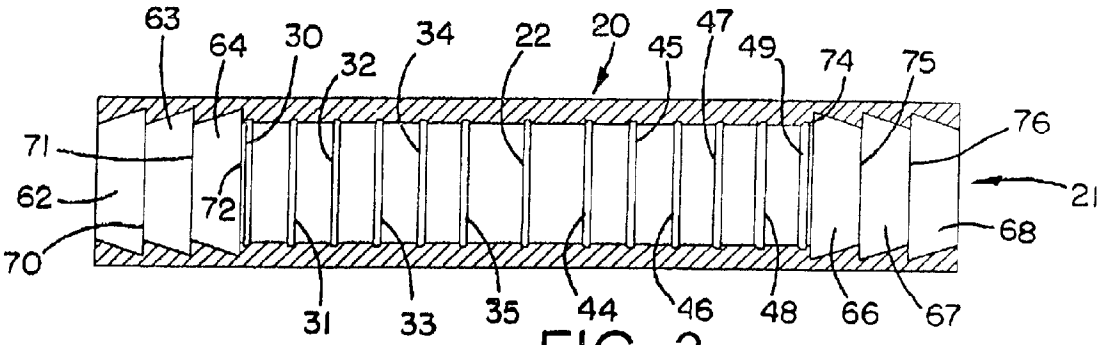
FIG. 3 is an axial section of the sleeve as seen from the line 3—3 of FIG. 4 but without the washers or bars.

On each side of the center groove 22 and the stop washer 23, the uniform wall thickness portion of the sleeve 20 is provided with a number of equally spaced grooves. On the left side of the disc 23, as seen in FIGS. 1, 2 and 3, the uniform wall thickness center portion of the sleeve is provided with grooves seen at 30, 31, 32, 33, 34, and 35. These grooves accommodate respective finger washers 36, 37, 38, 39, 40 and 41, which have their fingers shown generally at 42 oriented toward the mid-point of the sleeve 20 (toward the stop washer 23).

On the opposite side of the stop washer, the uniform wall thickness center section of the sleeve is provided with interior grooves seen at 44, 45, 46, 47, 48 and 49. These six grooves accommodate finger washers 52, 53, 54, 55, 56 and 57, respectively. These finger washers 52 through 57 in the equally spaced grooves are, however, oriented so that the fingers shown generally at 59 extend oppositely from the fingers 42 of the finger washers 36–41, that is, also toward the center stop washer 23. In this manner, the two sets of finger washers, six in each set, equally spaced along the uniform wall thickness center section of the sleeve are oriented or face in opposite directions.

The ends of the sleeve 20 beyond the uniform wall thickness center section are provided with tapered wedge shaped grooves as seen at 62, 63 and 64 on the left hand end and at 66, 67 and 68 on the right hand end, as illustrated. Each of the respective wedge shaped grooves forms a right angle stop shoulder. The stop shoulders formed by the wedge shaped grooves 62, 63 and 64 are shown at 70, 71 and 72, respectively. The stop shoulders on the right hand end as illustrated are shown at 74, 75 and 76 for the wedge shape grooves 66, 67 and 68, respectively.

As illustrated in FIGS. 1 and 2, the sleeve 20 may be provided with small ports seen at 80 and 81 on each side of the center stop washer or disc 23. This permits a hardenable matrix such as grout or epoxy resin, for example, to be injected into the sleeve after the bars 25 and 26 are in place. Examples of a suitable hardenable matrixes are Ciba's 4036/RP1500 epoxy system and Erico's HY10L grout.

Because of the orientation of the fingers, the bar shown at 25 may be inserted into the left hand end of the sleeve 20 seen in FIGS. 1 and 2, and the fingers 42 of the spring finger washers will deflect toward the center of the coupling permitting the bar to be inserted until the bar end 27 abuts against the center stop disc 23. The opposite orientation of the fingers of the washers on the opposite side permits the same thing with regard to the bar 26 and its end 28. Thus, both bars may be readily inserted into the opposite ends of the sleeve to abut against the center stop disc 23. However, the reinforced fingers of the washers will bite into the bar exterior surfaces and preclude withdrawal. When the sleeve is filled with the hardenable matrix such as the grout or epoxy, the splice is complete. It will, however, be appreciated that the splice can be accomplished either by inserting the bar ends into the sleeve or inserting the sleeve over at least one bar end.

The wedge grooves and axially outwardly facing shoulders at each end of the sleeve enhance the dynamic and/or fatigue strength characteristics of the coupling. It has been found that near the ultimate strength of the bar, the bar shrinks somewhat due to the Poisson effect and pulls away from the hardenable matrix. The configuration described above in elongation the hardenable matrix core tends to pull away from the wall of the sleeve at the end of the coupling as the coupling elongates and this structure enables the elongation without destructive consequences.

While the splice of FIGS. 1 and 2 illustrates a set of six spring finger washers on opposite sides of the center stop disc oppositely oriented, it will be appreciated that more or fewer may be employed. There should be at least three washers in each end of the sleeve and it will be appreciated that a total of more than six may be employed. It will also be appreciated that the washers in each end of the sleeve may not be of the same interior size. Thus, the oppositely arranged washer sets may accommodate reinforcing bar of different diameters thus providing a transition splice from one size bar to another.

Figure 5:
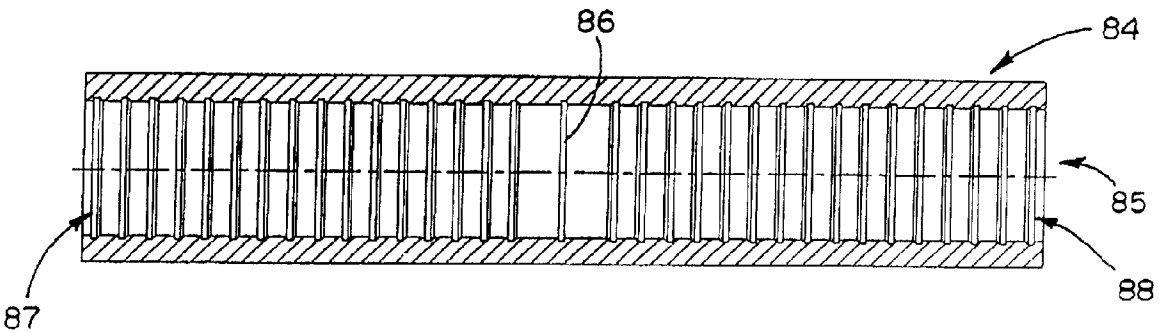
FIG. 5 is an axial section of another form of sleeve as seen from the line 5—5 of FIG. 6.
Figure 4:
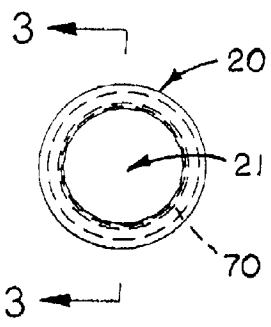
FIG. 4 is an end elevation of the sleeve of FIG. 3.
Figure 6:
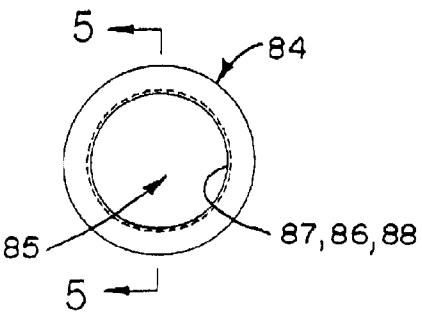
FIG. 6 is an end elevation of the sleeve of FIG. 5.

Referring now to FIG. 5, there is illustrated another form of sleeve shown generally at 84 which has a substantially uniform wall thickness throughout. The sleeve is provided with a through-hole or opening 85 and the mid-point of the sleeve is provided with an interior groove indicated at 86. Equally spaced on opposite sides of the center groove 86 are two sets of interior grooves shown at 87 and 88. In each set, there are sixteen equally spaced grooves which will accommodate sixteen equally spaced finger washers. The two sets of washers in each end will be oppositely oriented. Thus, each end of the splice may have as few as three washers in the set or as many as six, eight, ten or even sixteen or more. Again, with the washers in place and the bar ends inserted, the sleeve is filled with a hardenable matrix such as epoxy resin, grout or cement paste.

Figure 7:
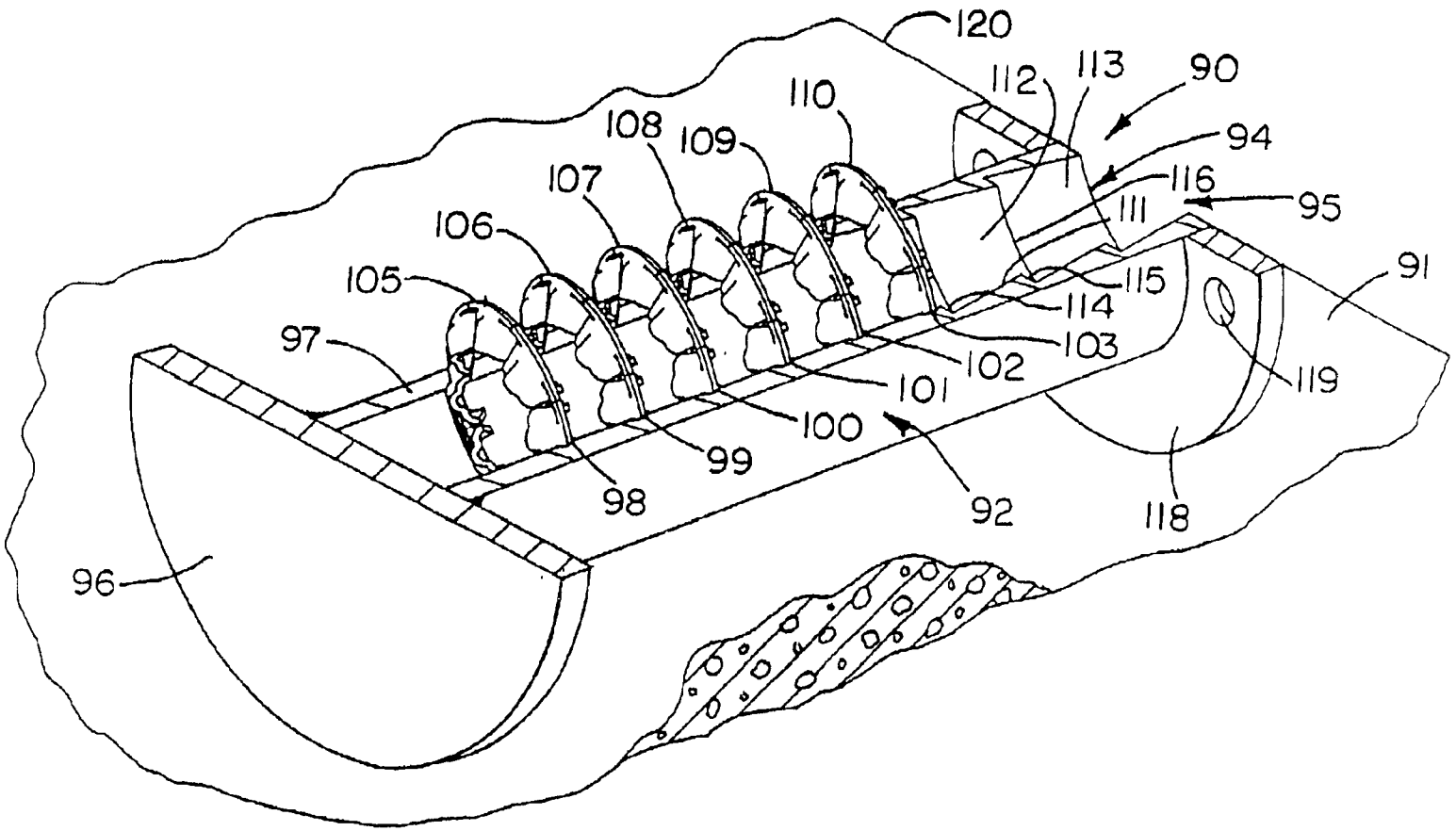
FIG. 7 is a broken perspective view of a connection useful in poured or cast concrete as an anchorage.

Referring now to FIG. 7, there is illustrated the connection of the present invention used as an anchorage connection shown generally at 90 in poured concrete 91. The connection 90 includes a sleeve 92 which may be approximately half the axial length of the sleeve seen in the embodiments of FIGS. 1 and 2. The sleeve is provided with a blind-hole 94 having an opening 95. The opposite end of the sleeve is closed by circular anchor plate 96. The plate 96 has a diameter larger than the sleeve and closes the blind end of the opening or hole 94. The plate 96 may be secured to the end of the sleeve as by welding.

The sleeve 92 includes in its inner uniform wall thickness section 97 equally spaced interior grooves 98, 99, 100, 101, 102 and 103, in which are mounted spring finger washers 105, 106, 107, 108, 109, and 110, respectively. The spring finger washers are oriented in the same manner as the right hand set in the embodiment of FIGS. 1 and 2 to permit a deformed reinforcing bar to be inserted into the opening 95 through the spring fingers of the washers and to bottom out against the interior of the anchor plate 96.

The outer end of the sleeve is provided with the three wedge grooves seen at 111, 112 and 113, which form the respective shoulders 114, 115 and 116. The outer or open end of the sleeve is provided with a flange 118 having holes 119 therein to enable the connection to be mounted on a form, not shown, which forms the concrete surface 120. The connection is simply secured to the form in the desired location by fasteners through the holes 119. The opening 95 may be plugged to prevent concrete paste intrusion into the interior of the sleeve. When the concrete form is removed after the concrete 91 hardens and the plug is removed, the opening 95 will be exposed at the concrete surface. A anchorage bar may then be inserted into the open end of the sleeve, forced through the fingers of the finger washer set, until the end of the bar contacts the interior of the anchor plate 96. The sleeve may then be filled with a hardenable matrix such as the noted grout or epoxy resin. In this manner, an anchorage bar may be anchored into the surface 120 of the previously poured concrete.

Referring now to FIGS. 8 through 12, it will be seen that the spring finger washer shown generally at 36 is provided with a circular rim 124, which fits within the appropriate groove inside the sleeve. In the illustrated embodiment, the washer 36 is provided with eight inwardly projecting reinforced fingers shown at 126, 127, 128, 129, 130, 131, 132 and 133. The detail of the fingers is seen more clearly in FIGS. 10, 11 and 12.

Figure 8:
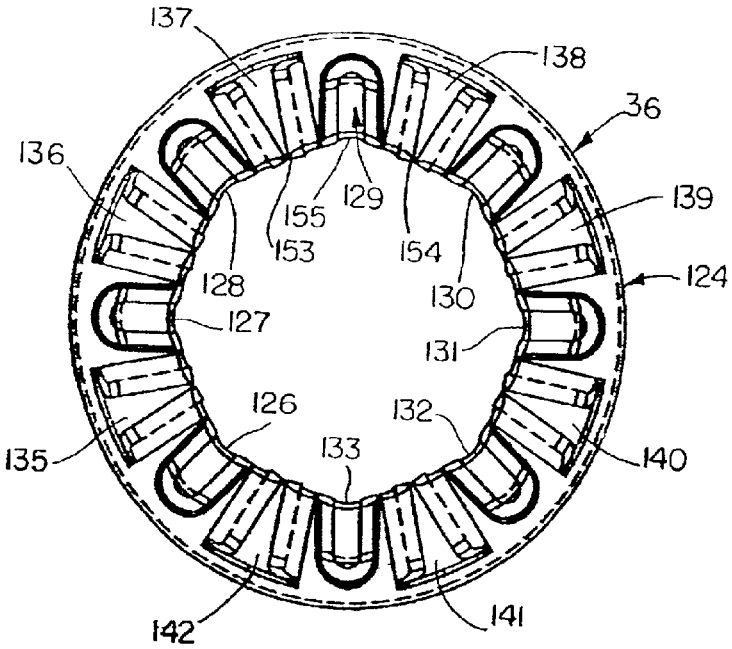
FIG. 8 is an axial plan view of a spring lock washer.
Figure 9:
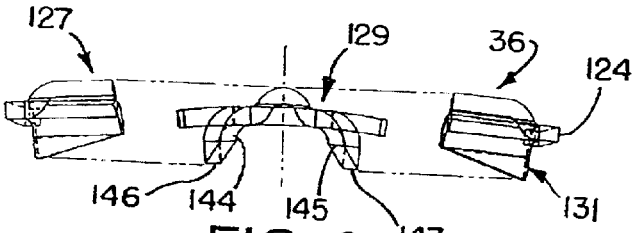
FIG. 9 is an edge view of the washer of FIG. 8 showing three of the eight fingers.
Figure 12:
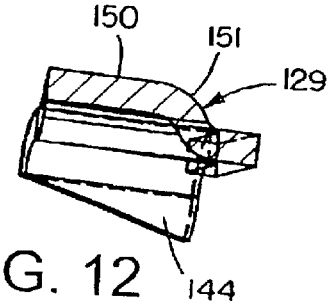
FIG. 12 is a radial section through the finger as seen from the line 12—12 of FIG. 11.

It should be noted that each finger shown in FIG. 8 is separated from the adjacent finger in a clockwise direction by a substantially open V-shape window which provides substantial openings through the spring finger washers to permit the hardenable matrix to flow around a reinforcing bar inserted into the connection and axially along the sleeve. These V-shape windows are shown at 135, 136, 137, 138, 139, 140, 141 and 142, reading clockwise around the washer from the finger 126. These openings are formed by bending the inwardly projecting edges of each finger as seen at 144 and 145 in FIGS. 9, 10 and 11, to form each finger into a general channel-shape. The radially extending bent edges of the fingers are provided with a pointed or chiseled edge indicated at 146 and 147, respectively, literally designed to bite into the bar as the inner edge of the finger deflects due to bar insertion. Each finger is additionally reinforced by a radially inwardly extending barrel vaulted section 150 extending inwardly from the half dome section 151, which is radially inwardly spaced from the rim 124.

Figure 10:
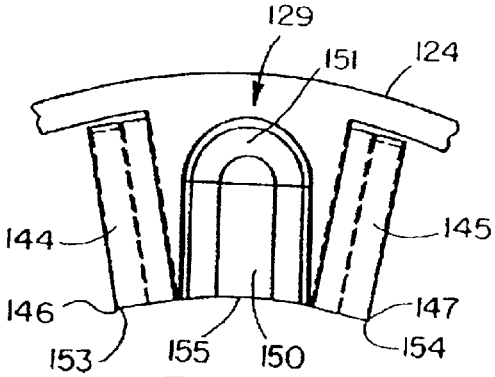
FIG. 10 is an enlarged axial plan view of one of the fingers.
Figure 11:
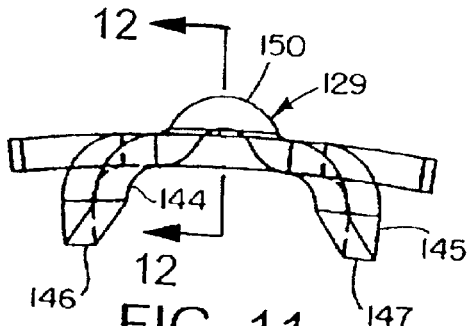
FIG. 11 is a further enlarged view of the finger reinforcement as seen from the bottom of FIG. 10.

As will be noted from FIGS. 8 and 10, the interior opening of the washer is not completely circular, and that each tooth presents a shallow V-shape configuration with the teeth 146 and 147 formed by the reinforcements 144 and 145 projecting radially further inwardly as seen at 153 and 154 than the center of the tooth as seen at 155.

When the washers are inserted in the mounting grooves in the interior of the sleeve and properly oriented, the fingers will be positioned to deflect as a bar is inserted, but bite into that bar to prevent withdrawal. The filling of the sleeve with a hardenable matrix such as the noted grout or resin completes the connection to form a connection having not only high compression and tensile strength, but also sufficient fatigue strength or characteristics to complete the cycle tests to qualify as a Type 2 coupler useful anywhere in any structure in any of the earthquake zones of the United States.

Figure 13:
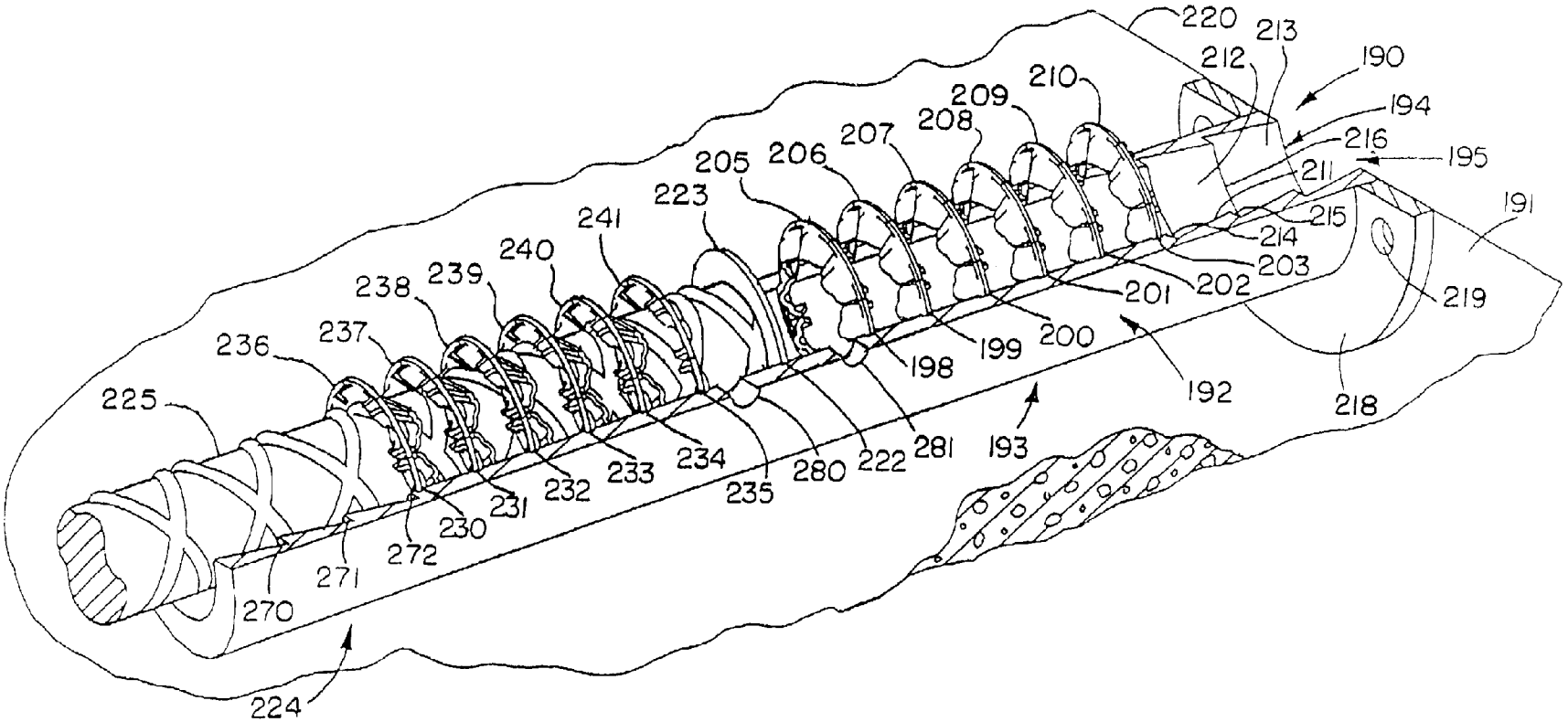
FIG. 13 is a broken perspective view of a connection useful in poured or cast concrete as a dowel bar, or continuity connection.

Referring now to FIG. 13, there is illustrated the connection of the present invention used as a dowel bar connection or continuity connection shown generally at 190 in poured concrete 191. The connection 190 includes a sleeve 192 which may be similar in length and interior configuration to the sleeve seen in the embodiments of FIGS. 1 and 2. The sleeve 192 is provided at a first end 193 with a hole 194 having an opening 195.

The first end 193 includes in its inner uniform wall thickness section 197 equally spaced interior grooves 198, 199, 200, 201, 202 and 203, in which are mounted spring finger washers 205, 206, 207, 208, 209, and 210, respectively. The outer end of the sleeve is provided with the three wedge grooves seen at 211, 212 and 213, which form the respective shoulders 214, 215 and 216. The outer or open end of the sleeve is provided with a flange 218 having holes 219 therein to enable the connection to be mounted on a form, not shown, which forms the concrete surface 220. The spring finger washers 205–210 are oriented in the same manner as the right hand set in the embodiment of FIGS. 1 and 2 to permit a deformed reinforcing bar to be inserted into the opening 195 through the spring fingers of the washers and to bottom out against a stop disc 223, which resides in a center groove 222.

A second end 224 of the sleeve 192 includes means to secure a reinforcing bar 225. The securing means includes grooves 230, 231, 232, 233, 234, and 235 which accommodate respective finger washers 236, 237, 238, 239, 240, and 241, which secure the bar 225 in a manner similar to that as described above with regard to the left hand set in the embodiment of FIGS. 1 and 2. The second end 224 also has stop shoulders formed at 270, 271, and 272. Ports at 280 and 281 may be provided to permit entry of the hardenable matrix.

The sleeve is secured onto the bar 225 in a manner which may be similar to the described above with regard to the embodiment of FIGS. 1 and 2. Then the connection may be simply secured to the form in the desired location by fasteners through the holes 219. The opening 195 may be plugged to prevent concrete paste intrusion into the interior of the sleeve. When the concrete form is removed after the concrete 191 hardens and the plug is removed, the opening 195 will be exposed at the concrete surface. A dowel bar or continuation bar may then be inserted into the open end of the sleeve, forced through the fingers of the finger washer set, until the end of the bar contacts the stop disc 223. The sleeve may then be filled with a hardenable matrix such as the noted grout or epoxy resin. In this manner, a continuation bar or dowel is anchored into the surface 220 of the previously poured concrete. This may be used in continuing pours, dowel bar connections, or the construction of continuation reinforcing from pour-to-pour in conventional concrete construction. With an additional bar inserted into the exposed end of the sleeve, the sleeve then is further filled with a hardenable matrix such as the grout or epoxy resin. After the connection is made, further pours will embed the additional rod in further concrete.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only be the scope of the claims.

What is claimed is:

1. A reinforcing bar connection for joining two reinforcing bars end-to end for use in reinforced concrete construction, comprising:

a sleeve, and spring finger washers mounted in said sleeve, wherein the washers each have a flexible inner edge adapted to expand around reinforcing bar ends projecting into each end of said sleeve and to bite into and grip the bar ends to prevent withdrawal.

2. A reinforcing bar connection as set forth in claim 1 including at least two sets of spring finger washers in said sleeve oppositely arranged to bite into and grip said bar ends inserted in each end of said sleeve.

3. A reinforcing bar connection as set forth in claim 2 wherein fingers of the washers include generally channel-shape cross-section formations.

4. A reinforcing bar connection as set forth in claim 2 including a stop-washer inserted in said sleeve to limit the extent of insertion of said bar ends inserted into the sleeve.

5. A reinforcing bar connection as set forth in claim 4 wherein said stop washer includes a central hole having a diameter less than that of the bar ends.

6. A reinforcing bar connection as set forth in claim 5 wherein the outside of each spring washer is mounted in a groove in said sleeve.

7. A reinforcing bar connection as set forth in claim 2 including from about three to about ten or more oppositely arranged washers in each set in each end of the sleeve.

8. A reinforcing bar connection as set forth in claim 1 including a hardenable matrix filling said sleeve after the bar is inserted, and wherein said spring finger washers include openings when said bar ends are inserted to enable said hardenable matrix to flow past said washers.

9. A reinforcing bar connection as set forth in claim 8 wherein said hardenable matrix is a resin.

10. A reinforcing bar connection as set forth in claim 8 wherein said hardenable matrix is a grout.

11. A reinforcing bar connection as set forth in claim 8 including at least one wedge-shape groove in the interior of said sleeve at an end thereof forming a shoulder facing the end.

12. A reinforcing bar connection as set forth in claim 11 wherein the wedge surface of said wedge-shape groove tapers to a smaller diameter toward the end of the sleeve and the shoulder is formed at the larger diameter.

13. A reinforcing bar connection as set forth in claim 12 including a plurality of wedge-shape grooves and shoulders at each end of the sleeve.

14. A reinforcing bar connection as set forth in claim 13, wherein the sleeve includes additional grooves, and wherein outer edges of the spring finger washers are mounted in respective of the additional grooves.

15. A reinforcing bar connection as set forth in claim 1, further comprising a flange attached to one end of the sleeve.

16. A reinforcing bar connection as set forth in claim 15, wherein the flanges has holes therein.

17. A method of connecting reinforcing bar in reinforced concrete construction, the method comprising arranging spring washers in a sleeve so as to provide a set of spring washers oppositely arranged in each end of said sleeve, said washers having a flexible inner edge, inserting a bar end in each end of said sleeve to deflect said washers so that the inner edge of said washers bites into and grips the bar ends to prevent withdrawal.

18. A method as set forth in claim 17 including the step of providing wedge grooves in each end of the sleeve, and filling the sleeve with a hardenable matrix.

19. A method as set forth in claim 17 including the step of providing at least two wedge grooves and shoulders in each end of the sleeve, and at least three washers in each end of the sleeve.

* * * * *